United States Patent [19]

Ballard

[11] Patent Number: 5,050,520

[45] Date of Patent: Sep. 24, 1991

[54] FUME EXHAUSTION SAFETY DEVICE

[75] Inventor: Elmer I. Ballard, P.O. Box 1866, Council Bluffs, Iowa 51502

[73] Assignees: Elmer I. Ballard, Council Bluffs, Iowa; Emmett L. Steffes, Omaha, Nebr.; Stephen M. Davis, Missouri Valley; Don Frerichs, Malvern, both of Iowa

[21] Appl. No.: 627,733

[22] Filed: Dec. 14, 1990

[51] Int. Cl.[5] ..... B63J 2/00

[52] U.S. Cl. ..... 114/211; 440/89; 60/324; 98/1; 181/238

[58] Field of Search ..... 114/211; 440/1, 89; 60/317, 322, 324; 307/9; 98/1; 181/212, 225, 235, 238, 239

[56] References Cited

U.S. PATENT DOCUMENTS 2,573,986 11/1951 Roper ..... 440/89
3,315,584 4/1967 Van Ranst ..... 98/1
3,489,912 1/1970 Hoffman, Jr. ..... 307/9
4,773,215 9/1988 Winberg et al. ..... 440/89

*Primary Examiner*—Jesus D. Sotelo
*Attorney, Agent, or Firm*—Zarley, McKee, Thomte, Voorhees & Seas

[57] ABSTRACT

A fume exhaustion safety device is designed for use on a boat having an internal combustion engine mounted within a closed engine compartment. An exhaust vent tube extending from the engine compartment to exhaust gaseous fluid to the exterior of the boat includes a blower fan to move the gases through the vent tube. The safety device includes a shutter or sail pivotally mounted within the vent tube to operate a microswitch when gaseous fluid moves through the vent tube. The microswitch is electrically connected to the ignition switch of the boat, the engine starter and the blower fan so as to prevent the connection of electrical power to the starter when the blower fan switch is on but no gaseous fluid is flowing through the vent tube.

9 Claims, 5 Drawing Sheets

FUME EXHAUSTION SAFETY DEVICE

TECHNICAL FIELD

The present invention relates generally to the exhaustion of fumes from the engine compartment of a boat, and more particularly to a safety device which detects the proper exhaustion of fumes from the engine compartment.

BACKGROUND OF THE INVENTION

Conventional boats with inboard internal combustion engines have their engines located within a closed engine compartment in order to separate the boat passengers from the noise and noxious fumes of the engine. Substantial problems may arise from the location of the engine within a closed compartment in view of the possible accumulation of combustible vapors within the compartment. Unless these accumulated combustible vapors are exhausted from the compartment, an explosion may occur upon engine start-up, potentially causing severe damage and personal injury.

While combustible vapor detectors 1 are known in the art, such detectors merely provide an indication as to whether a substantial accumulation of detectable vapors exists in the engine compartment. Even if the detector is working properly, an inattentive operator may still attempt to start the engine, regardless of any accumulation of combustible vapors.

Another problem with conventional vapor detectors is the short life span of many components within the detector due to the marine environment. Oxidation and other environmental factors dramatically shorten the life of the sensitive electrical components of a detector. Previous attempts to overcome these problems have relied on electrical circuits tied into an exhaust vent in the engine compartment which prevent starting of the engine unless the exhaust fan has been activated. In some cases, a time delay circuit is utilized to permit a predetermined amount of venting of the engine compartment before the starting circuit may be energized. The main problem with such devices is that the circuits rely on activation of a vent fan, rather than actual venting of the engine compartment. In the event that the passageway venting fumes from the engine compartment becomes blocked, the fan may still be energized and the engine started regardless of the fact that fumes have not actually been vented.

It is therefore a general object of the present invention to provide an improved fume exhaustion safety device.

Another object of the present invention is to provide a fume exhaustion safety device which is controlled by the physical movement of fumes from the engine compartment.

Another object is to provide a fume exhaustion safety device which is resistant to the elements of a marine environment, so as to provide for a long life.

A further object of the present invention is to provide a fume exhaustion safety device which prevents start-up of an engine prior to actual physical exhaustion of fumes from the engine compartment.

Still another object is to provide a fume exhaustion safety device which is simple to operate and economical to manufacture.

These and other objects will be apparent to those skilled in the art.

SUMMARY OF THE INVENTION

The fume exhaustion safety device of the present invention is designed for use on a boat having an internal combustion engine mounted within a closed engine compartment. An exhaust vent tube extending from the engine compartment to exhaust gaseous fluid to the exterior of the boat includes a blower fan to move the gases through the vent tube. The safety device includes a shutter or sail pivotally mounted within the vent tube to operate a microswitch when gaseous fluid moves through the vent tube. The microswitch is electrically connected to the ignition switch of the boat, the engine starter and the blower fan so as to prevent the connection of electrical power to the starter when the blower fan switch is on but no gaseous fluid is flowing through the vent tube.

DESCRIPTION OF THE PREFERRED EMBODIMENTS

Figure 1:
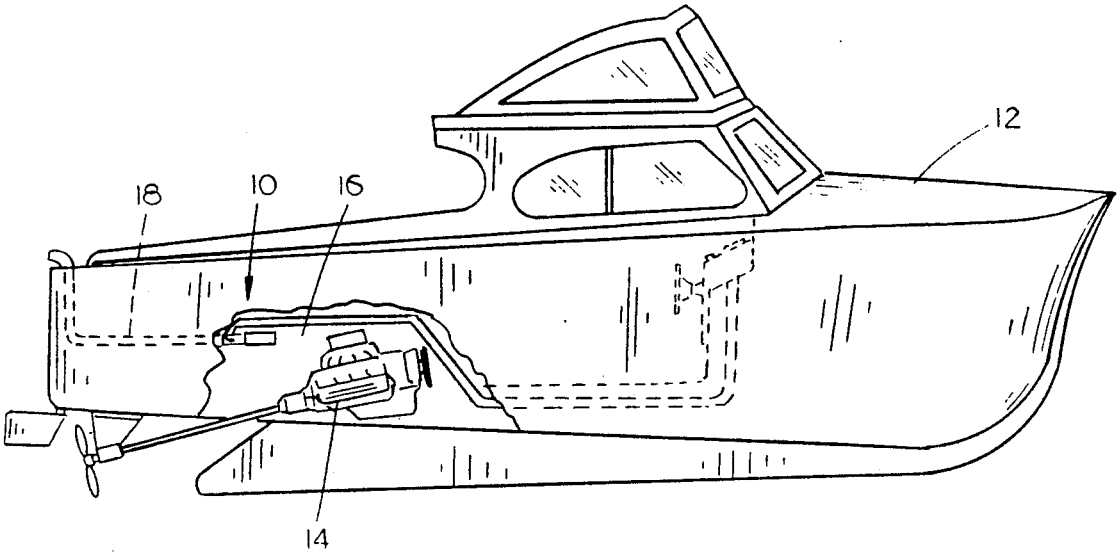
FIG. 1 is a side elevational view of a boat with portions cut away to show the engine compartment and fume exhaustion safety device of the present invention.

Referring now to the drawings, in which similar or corresponding parts are identified with the same reference numeral, and more particularly to FIG. 1, the fume exhaustion safety device of the present invention is designated generally at 10 and is mounted on a boat 12 of the type having an internal combustion engine 14 located within a closed engine compartment 16. A vent tube 18 extends from the interior of the engine compartment 16 to the exterior of the boat so as to exhaust fumes from engine compartment 16.

Figure 2:
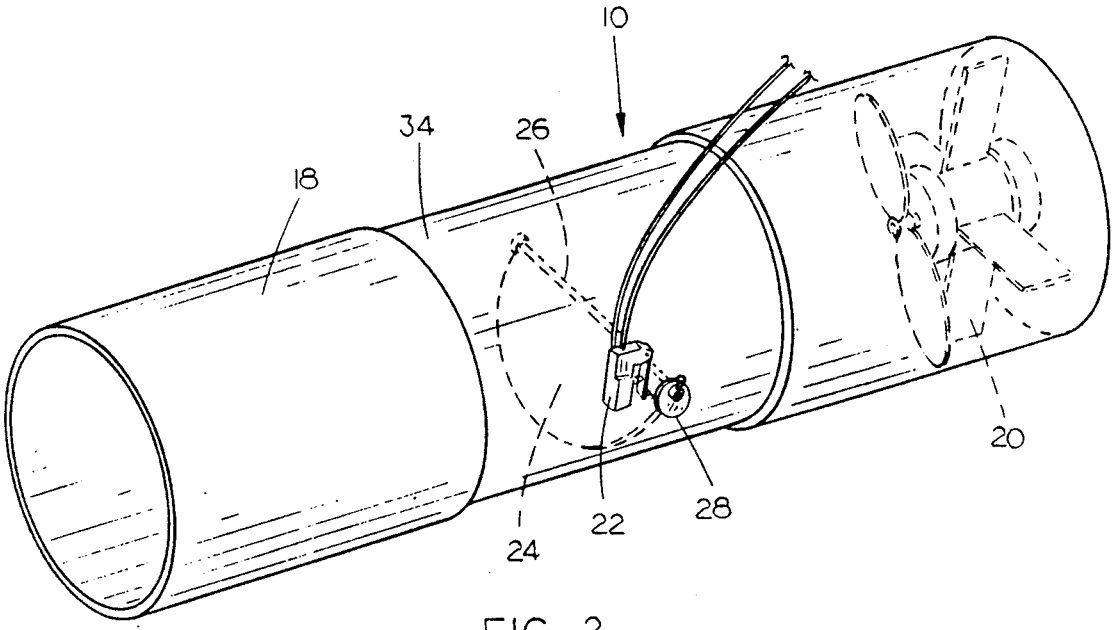
FIG. 2 is a perspective view of the present invention mounted on the vent tube extending from the engine compartment of the boat.

Referring now to FIG. 2, vent tube 18 has an electrical fan 20 mounted therein to move air therethrough, so as to exhaust fumes from the boats engine compartment. The safety device 10 includes a microswitch 22 which is operably associated with a pivotable shutter 24, the shutter being pivotably mounted within vent tube 18. Preferably, shutter 24 is semi-circular in shape so as to match the interior diameter of vent tube 18. A pivot pin 26 extends horizontally across the diameter of vent tube 18, and pivotally suspends shutter 24.

Figure 3:
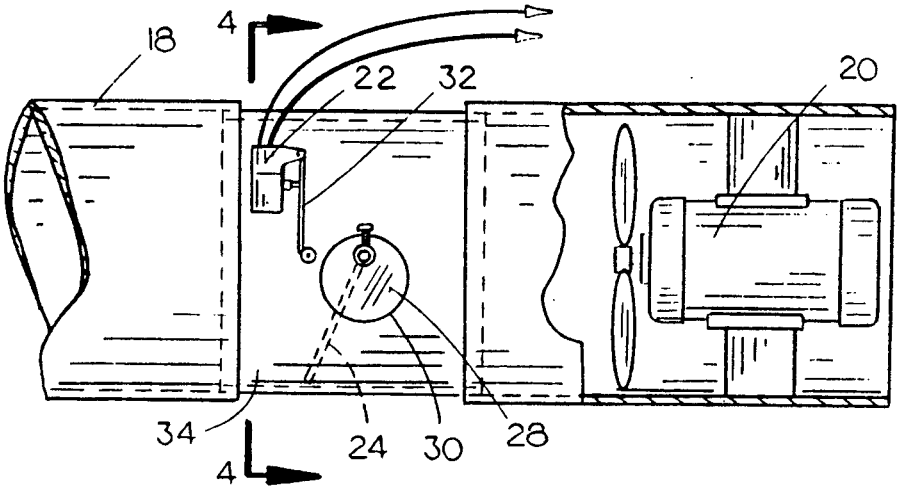
FIG. 3 is a side elevational view of FIG. 2.
Figure 4:
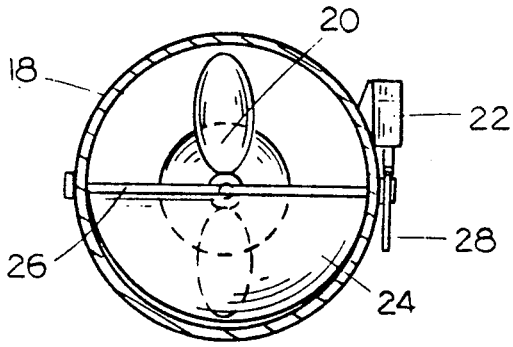
FIG. 4 is a sectional view taken at lines 4—4 in FIG. 3.
Figure 5:
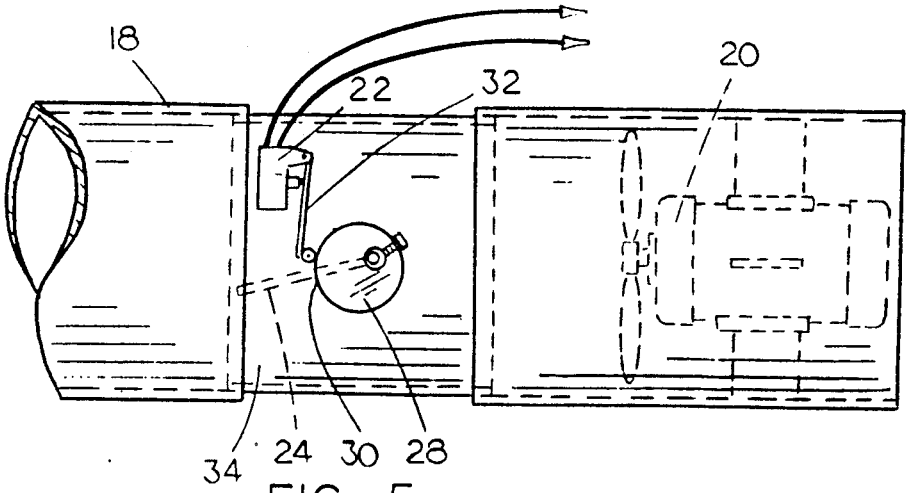
FIG. 5 is a view similar to FIG. 3, with the safety device of the present invention in an activated condition.

A cam 28 is mounted on one end of pivot pin 26 upon the exterior of vent tube 18, and is eccentrically mounted as shown in FIGS. 3 and 5. Thus, cam 28 has a distal edge 30 which moves with the rotation of cam 28 on pivot pin 26.

Microswitch 22 is mounted with a depending lever arm 32 oriented adjacent cam 28, such that rotation of cam 28 will bring distal edge 30 into contact with lever arm 32 so as to activate microswitch 22, as shown in FIG. 5. Cam 28 is mounted on pivot pin 26 for rotational movement as shutter 24 is pivoted, as shown in FIGS. 3 and 5. Preferably, distal edge 30 is oriented out of contact with lever arm 32 when there is no air flow through vent tube 28 (see FIG. 3). Microswitch 22 is located such that pivotal movement of shutter 24 to a predetermined position will rotate cam 28 such that distal edge 30 activates microswitch 22, so as to close the circuit.

In operation, activation of fan 20 will cause air to flow through vent tube 18 so as to exhaust fumes from the engine compartment. If air is freely flowing through tube 18, shutter 24 will be pivoted from a vertical position to a generally horizontal position by the force of air flow on its surface, as shown in FIG. 5. This in turn closes an electrical circuit in microswitch 22 to permit starting of the engine. However, if vent tube 18 is plugged or blocked, no air flow will pass through the vent tube and shutter 24 will remain in a generally vertical position, as shown in FIG. 3. This in turn causes microswitch 22 to remain open, preventing starting of the engine. In this fashion, the boat operator will not be capable of starting the engine if vent tube 18 is blocked, even though the fan 20 is appropriately energized.

In order to permit easy installation of shutter 24, the shutter is preferably mounted within a short section of hollow tube 34, having a diameter designed to telescope within vent tube 18. In this way, vent tube 18 may be cut downstream of fan 20, separated, and hollow tube 34 inserted therein with shutter 24 in operable position.

Figure 6:
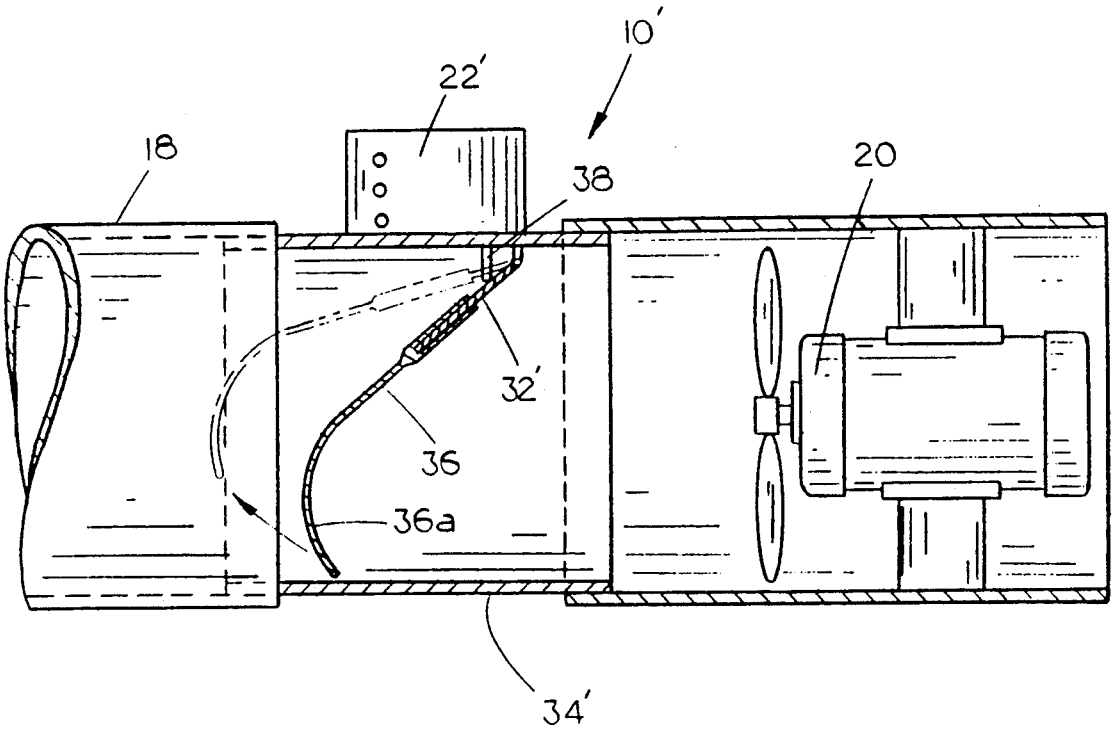
FIG. 6 is a longitudinal sectional view through the vent tube showing a second embodiment of the invention.

Referring now to FIG. 6, a second embodiment of the invention is designated generally at 10' and includes a hollow tube 34' telescopically inserted within vent tube 18 downstream of fan 20. A microswitch 22' is mounted on top of hollow tube 34' with its pivotable lever arm 32' depending within hollow tube 34'. In this embodiment, a sail 36 is connected directly to lever arm 32' and has an arcuate lower portion **36*a* which will catch the flow of air so as to move lever arm 32' upwardly against the plunger 38 of microswitch 22'. As with the first embodiment, microswitch 22' is in a normally open condition when sail 36 is in its solid line position in FIG. 6. Microswitch 22' is activated to a closed condition when sail 36 is moved upwardly to the broken line position of FIG. 6, once fan 20 is activated to move air against sail 36**.

Figure 7:
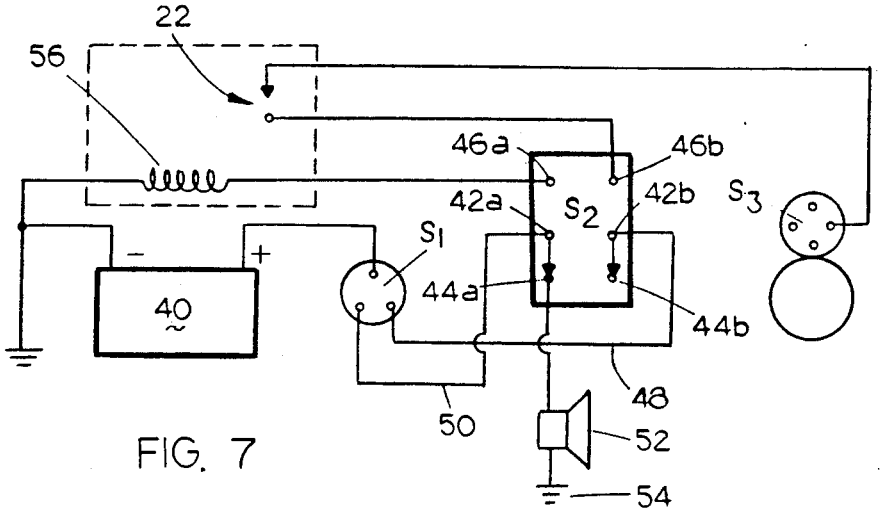
FIG. 7 is a schematic of a preferred embodiment of the present invention.

A schematic diagram is shown in FIG. 7 which utilizes the safety device of the present invention. A battery 40 has its positive terminal connected to an ignition switch S1, and its negative terminal connected to ground. A blower motor switch S2 is a double pole double throw switch having a pair of center terminals **42*a* and 42*b*, lower terminals 44*a* and 44*b* and upper terminals 46*a* and 46*b*. One conductor 48 is connected between a terminal on switch S1 and a center terminal 42*b* on S2. A second conductor 50 is connected to a third terminal on switch S1 and a center terminal 42*a* on switch S2. When ignition switch S1 is turned to a "on" position, conductors 48 and 50 are electrically connected to the positive terminal of battery 40. In FIG. 7, blower motor switch S2 is shown in the "off" position, with the center terminals electrically connected to the lower terminals 44*a* and 44*b*. An alarm horn 52 is electrically connected to lower terminal 44*a* and is grounded at 54, such that horn 52 will be energized when switch S2 is off and switch S1** is on.

Figure 8:
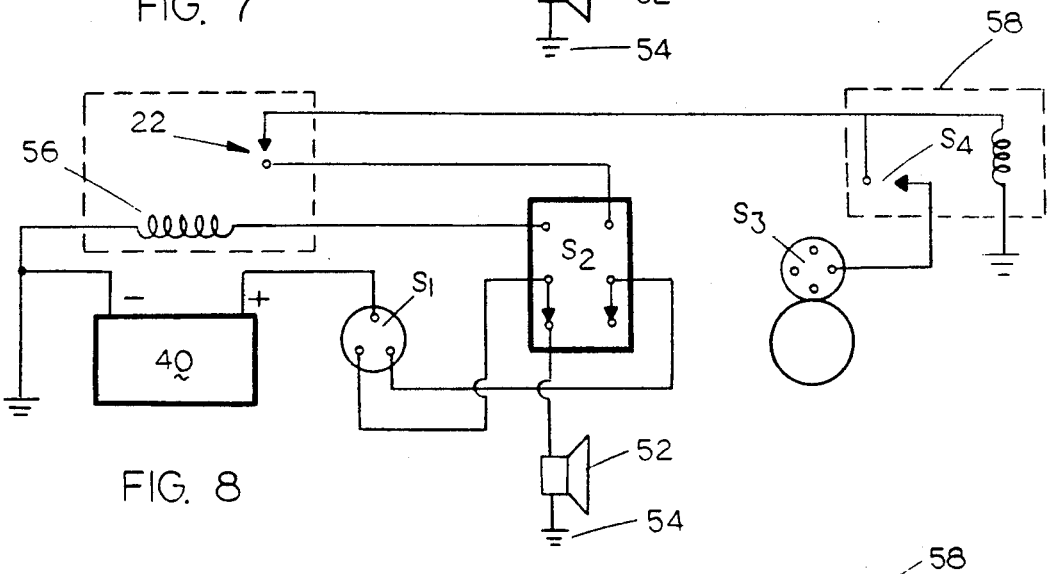
FIG. 8 is a schematic of a second embodiment of the invention.

Upper terminal **46*a* of switch S2 is connected to blower motor 56 and thence to ground. The negative terminal of battery 40 is also connected to ground. Thus, when switch S2 is switched to the "on" position and switch S1 is switched to the "on" position, blower motor 56 will be activated and alarm horn 52 will be deactivated. Upper terminal 46*b* is connected in series with microswitch 22 and starting solenoid switch S3. Thus, when switch S1 is turned on and switch S2 is turned on, blower motor 56 will be activated and switch S3 will be turned on in the event that microswitch 22 is closed. As noted above, microswitch 22 is only closed when adequate air movement passes through the exhaust vent tube. Thus, the engine cannot be started if sufficient air is not moving through the exhaust vent. Referring now to FIG. 8, the schematic shown is identical to the schematic of FIG. 7, except for the addition of a timing circuit in series between microcircuit 22 and starter solenoid switch S3. Timing circuit 58 will close the circuit between microswitch 22 and starter solenoid switch S3 after a predetermined time period, by closing switch S4. In this way, the blower motor must run for a predetermined period of time before the boat engine may be started utilizing starter solenoid switch S3**.

Figure 9:
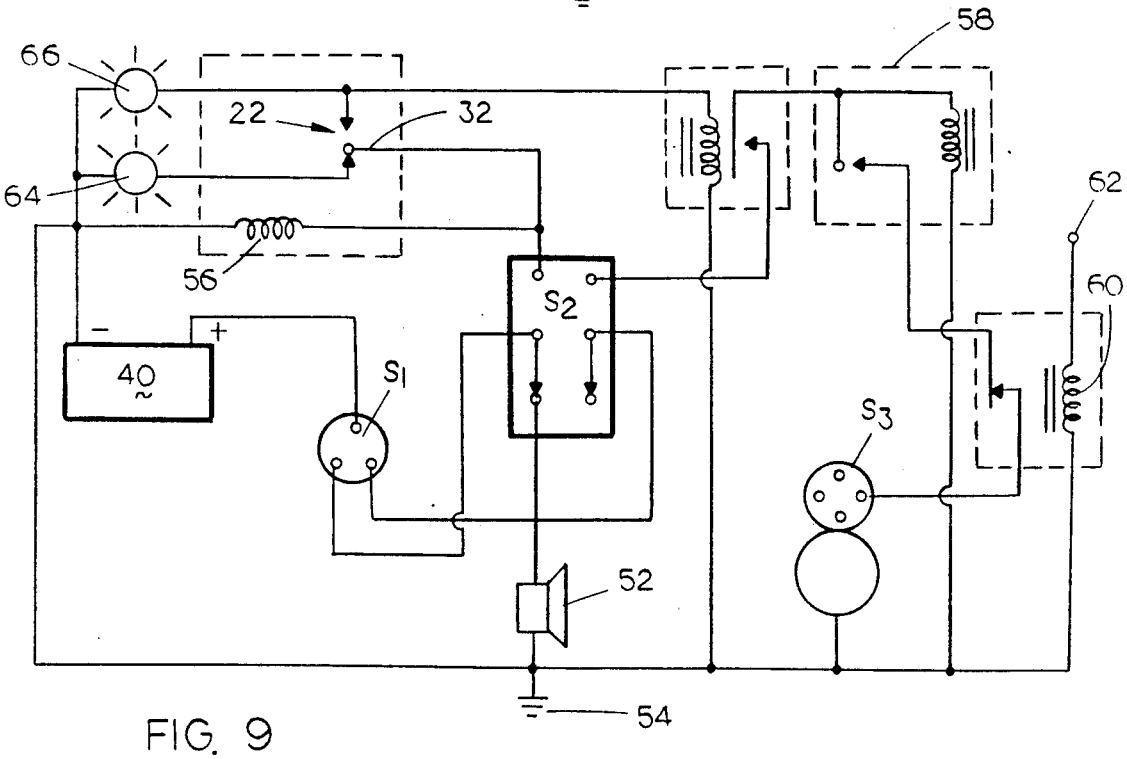
FIG. 9 is a schematic of a third embodiment of the invention.

Referring now to FIG. 9, the schematic shown is identical to FIG. 8 with the addition of a fume detector solenoid 60 connected to a fume detector 62, interposed between timing circuit 58 and starter solenoid S3. Fume detector solenoid 60 will prevent closing of the circuit to start the engine if an excessive amount of combustible fumes are detected.

In addition, the schematic of FIG. 9 adds a red lamp in series between the lever arm 32 of microswitch 22 and ground, and a green lamp between timing circuit 58 and ground. In this way, the red light will be illuminated when the blower motor 56 is activated but microswitch 22 is in the open position. Green light 66 will be activated when blower motor 56 is activated and microswitch 22 is in the closed position.

Figure 10:
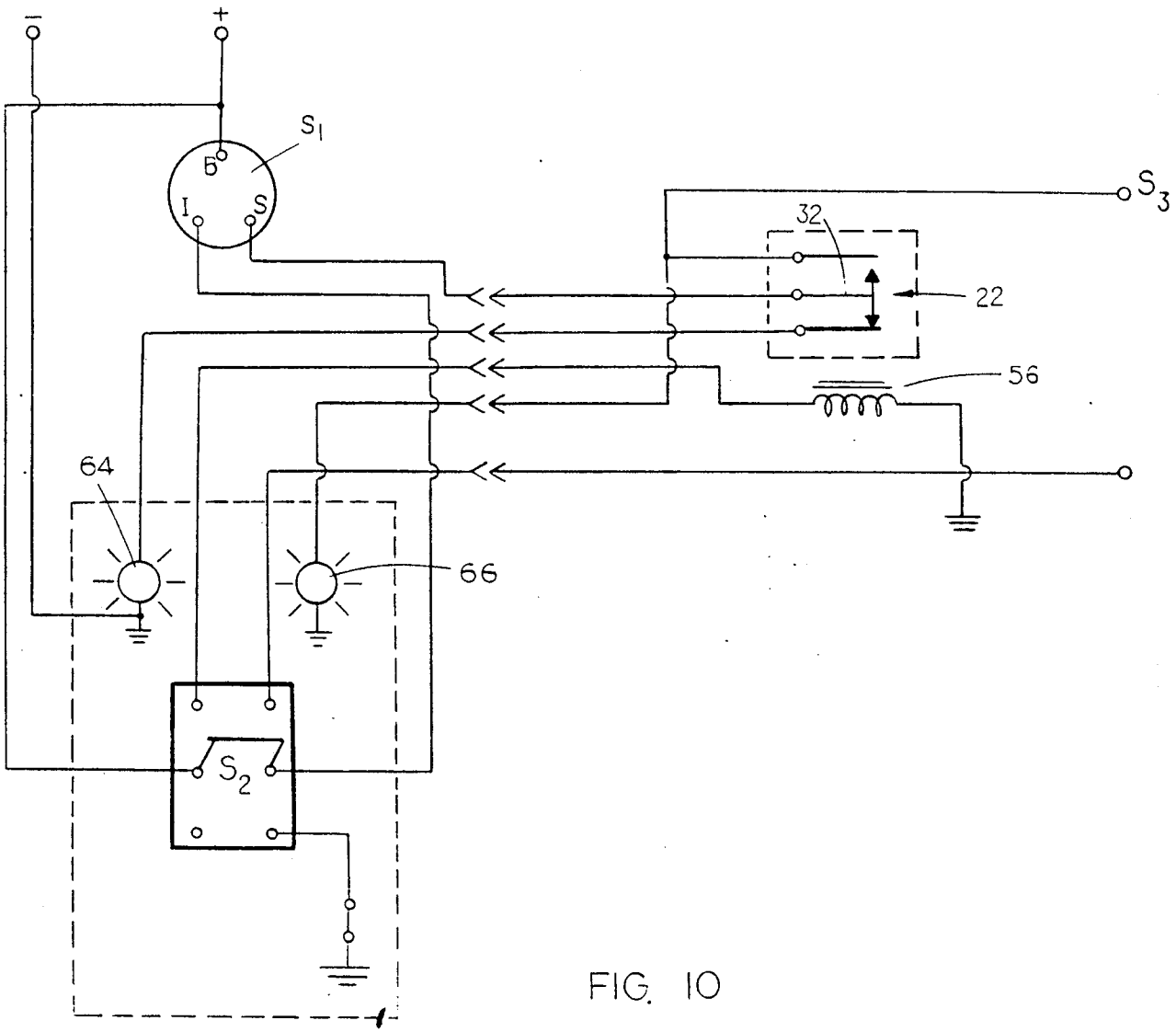
FIG. 10 is a schematic of a fourth embodiment of the invention.

Referring now to FIG. 10, the schematic shown is similar to FIG. 9, but is rearranged in a more practical way for the circuitry to function, as applied specifically to a boat. As can be seen in the drawing, the blower motor switch S2 must be turned on and the fume arrester switch 22 must be activated or the electrical circuits at the engine will not be energized. A timing motor, clock or bimetalic thermo switch can be inserted in series with the starter solenoid to allow for a time delay before starting the engine. In addition, a fume or vapor detector for hydrocarbons can be easily inserted into the circuit for added protection.

Whereas the invention has been shown and described in connection with the preferred embodiments thereof, it will be understood that many modifications, substitutions and additions may be made which are within the intended broad scope of the appended claims. There has therefore been shown and described an improved fume exhaustion safety device which accomplishes at least all of the above stated objects.

I claim:

1. A fume exhaustion safety device, comprising:

a hollow tubular member for the passage of a gaseous fluid from an upstream end to a downstream end;

means connected to said tubular member for detecting the flow of gas through said tubular member; and electrical switch means operably connected to said gas flow detecting means, operable to a first position to open an electrical circuit when no gas is flowing through the tubular member, and operable to a second position to close an electrical circuit when gas is flowing through said tubular member.

2. The safety device of claim 1, wherein said electrical switch means is operable to close an electrical circuit only upon the flow of a predetermined rate of flow of gas through said tubular member.

3. The safety device of claim 1, wherein said gas flow detecting means includes:

a shutter means pivotally mounted within said hollow tubular member, having a wind resistant surface oriented generally perpendicularly to the flow of gas through said tubular member;

said shutter means mounted so as to pivot from a first position to a second position upon the flow of gas through said tubular member;

said electrical switch means being connected to said shutter means so that said electrical switch means is in the first position when the shutter means is in the first position, and such that the switch means is in the second position when the shutter means is in the second position.

4. The safety device of claim 3, wherein said shutter means is mounted on a pivot pin which extends through diametric sides of said hollow tubular member.

5. The safety device of claim 4, further comprising a cam mounted on one end of said pivot pin exteriorly of said tubular member, for rotational movement with said pivot pin, said cam being located in operative association with said electrical switch means so as to engage said switch means and move it to said second position when the shutter means is in the second position, and to disengage said switch means when the shutter means is in the first position.

6. In combination:

a boat having an internal combustion engine mounted within a closed engine compartment;

an exhaust vent tube extending from said engine compartment to exhaust gaseous fluid to the exterior of the boat;

said vent tube having a blower fan to move gas through said vent tube;

a control panel having an ignition switch operable between "on" and "off" positions for connecting and disconnecting electrical power to an engine starter, and a blower fan switch operable between "on" and "off" positions for connecting and disconnecting said blower fan to a source of electricity; and a fume exhaustion safety device mounted on said vent tube and electrically connected to said control panel for preventing the connection of electrical power to said starter when the blower fan switch is on but no gas is flowing through said vent tube.

7. The combination of claim 6, wherein said fume exhaustion safety device includes:

means connected to said exhaust vent tube for detecting the flow of gas through said tube;

electrical switch means operably connected to said gas flow detecting means, and electrically connected to said control panel, and operable to a first position to open the electrical circuit to said engine starter when no gas is flowing through the tube, and operable to a second position to close the electrical circuit to said engine starter when gas is flowing through said tube.

8. The safety device of claim 7, wherein said gas flow detecting means includes:

a shutter means pivotally mounted within said exhaust vent tube, having a wind resistant surface oriented generally perpendicular to the flow of gas through said tube;

said shutter means mounted so as to pivot from a first position to a second position upon the flow of gas through said tube;

said electrical switch means being mechanically connected to said shutter means such that the electrical switch means is in the first position when the shutter means is in the first position, and such that the electrical switch means is in the second position when the shutter means is in the second position.

9. A method for modifying a boat of the type having an internal, combustion engine mounted within a closed engine compartment, the boat having an exhaust vent tube extending from the engine compartment to exhaust gaseous fluid to the exterior of the boat, the vent tube having a blower fan to move gas through the vent tube, and the boat having a control panel with an ignition switch operable between on and off positions for connecting and disconnecting electrical power to an engine starter, and a blower fan switch operable between on and off positions for connecting and disconnecting said blower fan to a source of electricity, comprising these steps of:

providing a fume exhaustion device, including:

a hollow tubular member having a diameter to telescope within said exhaust vent tube;

means connected to said tubular member for detecting the flow of said gas through said tube; and electrical switch means operably connected to said gas flow detecting means operable to a first position to open an electrical circuit when no gas is flowing through the tube, and operable to a second position to close an electrical circuit when gas is flowing through said tube;

cutting said boat exhaust vent tube downstream of said blower fan and separating the upstream and downstream sections;

installing said hollow tubular member between said upstream and downstream vent tube sections so as to telescope therein;

sealing said hollow tubular member between said upstream and downstream sections to prevent leakage of gases out of said exhaust vent tube;

electrically connecting said electrical switch means to said control panel so as to open the electrical circuit to said engine starter when said electrical switch means is open, and closing said circuit to said engine starter when the electrical switch means is in its second position.

* * * * *